United States Patent [19]

Einsele et al.

[11] Patent Number: 4,747,171

[45] Date of Patent: May 31, 1988

[54] HOSPITAL BED RAIL ASSEMBLY

[75] Inventors: Philip Einsele, Charlotte; Robert B. Sanchez, Matthews, both of N.C.

[73] Assignee: Simmons Healthcare, Inc., Charlotte, N.C.

[21] Appl. No.: 895,767

[22] Filed: Aug. 12, 1986

[51] Int. Cl.[4] ..... A47C 21/08

[52] U.S. Cl. ..... 5/425; 5/429; 5/430

[58] Field of Search ..... 5/424, 425, 427–430

[56] References Cited

U.S. PATENT DOCUMENTS

| | | | |
|---|---|---|---|
| 304,217 | 8/1884 | McMann | 5/430 |
| 2,750,605 | 6/1956 | Blevins | 5/430 |
| 2,817,855 | 12/1957 | Pratt | 5/430 |
| 3,081,463 | 3/1963 | Williams et al. | 5/430 X |
| 3,100,899 | 8/1963 | Wright | 5/430 |
| 3,585,659 | 6/1971 | Burst et al. | 5/430 |
| 3,855,654 | 12/1974 | Pivacek | 5/100 X |
| 3,932,903 | 1/1976 | Adams et al. | 5/100 |
| 4,612,679 | 9/1986 | Mitchell | 5/428 X |

*Primary Examiner*—Michael F. Trettel
*Attorney, Agent, or Firm*—A. Thomas Kammer

[57] ABSTRACT

A hospital bed having a storable safety rail is provided. The bed includes a frame having a pair of laterally extending slide tubes mounted thereto. A pair of mounting shafts are positioned within the tubes and secure the safety rail to the frame. A stop member is positioned near the inner end of at least one of the tubes. The mounting shaft includes a projection which abuts the stop member when in a first rotational position, but is able to pass thereby when in a second rotational position. The stop member preferably includes an inclined surface opposing the inner end of the slide tube to urge the projection, and therefore the rail, outwardly as the mounting shafts rotate to move the rail to the raised position. A retraction spring is provided for urging the safety rail towards the bed frame while in the lowered position. The safety rail also includes a brake mechanism to resist the gravitational forces urging it downwardly from the raised position.

18 Claims, 7 Drawing Sheets

FIG. 8
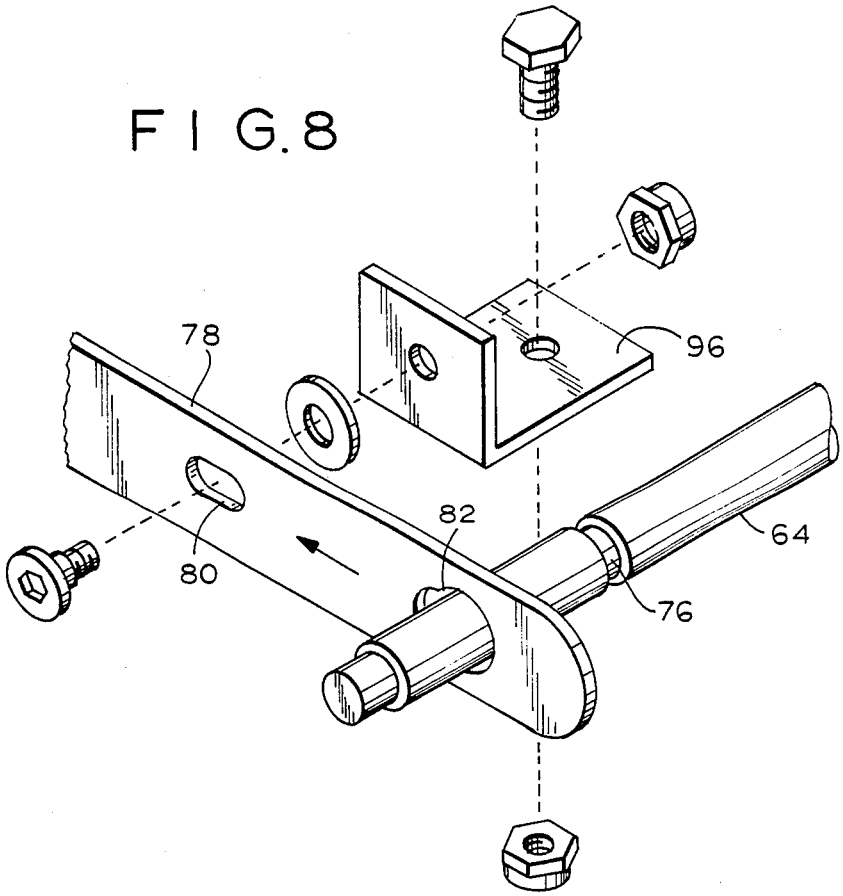
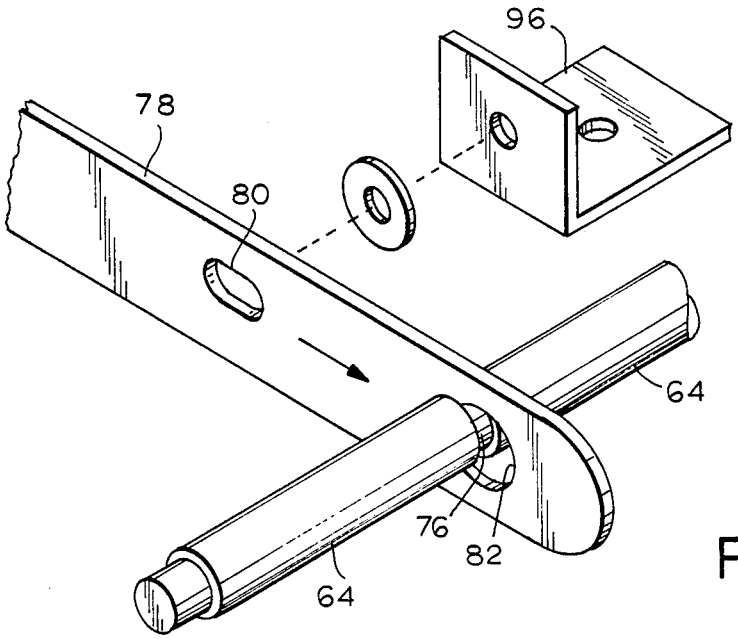
FIG. 9

HOSPITAL BED RAIL ASSEMBLY

BACKGROUND OF THE INVENTION

The field of the invention relates to a rail assembly which is movable in the vertical plane and/or storable beneath a hospital bed.

Safety bed rails are provided on virtually all hospital beds to prevent patients from injury. The rails are movable at least between down and up positions to allow the patient access to and from the bed. Some rail assemblies are storable under the bed when in the down position, thereby minimizing the space occupied by the bed itself. U.S. Pat. No. 3,081,463 is directed to such a rail assembly. The rail pivots downwardly from the up position when unlatched and swings beneath the bed for storage. U.S. Pat. No. 3,855,654 discloses a safety bed rail assembly which collapses to a down position. A pair of pivot arms allows it to be stored under the bed. Finally, U.S. Pat. No. 3,932,903 discloses a rail assembly mounted to a pair of pivot arms which allows it to be moved between up and down positions. The rail assembly may be stored under the bed by sliding it along a pair of support rods.

SUMMARY OF THE INVENTION

The invention concerns a bed rail assembly including a first mechanism for moving it vertically between up and down positions and a second mechanism which allows it to be stored under the bed to which it is mounted. A braking mechanism is also provided for preventing the rail assembly from falling too rapidly to the down position when unlatched.

The storage mechanism includes a pair of mounting shafts secured to a pair of pivot arms. The pivot arms allow the rail to be moved vertically. A pair of slide tubes mounted to the bed frame are provided for receiving the mounting shafts. A projection extends from an end portion of at least one of the mounting shafts associated with the rail. A stop member is secured to the bed frame for abutting against the projection member when the rail is in the raised position. The projection rotates with the mounting shaft as the rail pivots downwardly and into a position where it will not abut the stop member. The rail may accordingly be stored under the bed as the mounting shafts slide within the slide tubes.

Means such as springs may be provided for urging the rail towards the stored position. A latch is provided for maintaining the rail in a first horizontal position from where it can be raised. When this latch is released, the rail automatically move under the bed.

The braking mechanism includes a spring which resists downward movement of the rail and assists the upward movement thereof. The rail accordingly will not tend to fall rapidly under the force of gravity.

BRIEF DESCRIPTION OF THE DRAWINGS

FIGS. 8 and 9 are enlarged, perspective views of a locking mechanism for locking the rail assembly shown in FIGS. 1 and 2 in a desired position, the figures showing a portion of the rail assembly in two different positions.

DETAILED DESCRIPTION OF THE INVENTION

Figure 1:
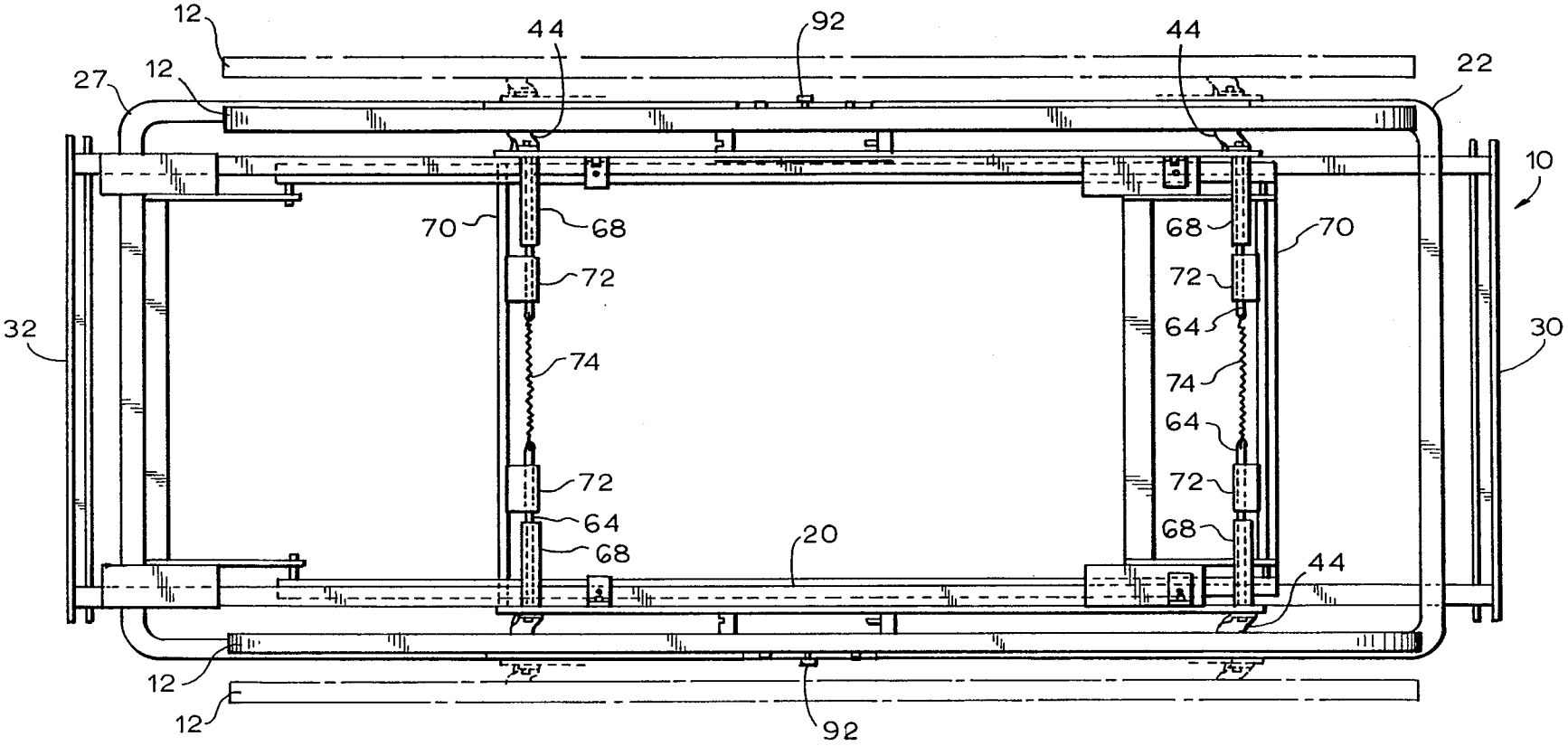
FIG. 1 is a top plan view of a hospital bed according to the invention.
Figure 2:
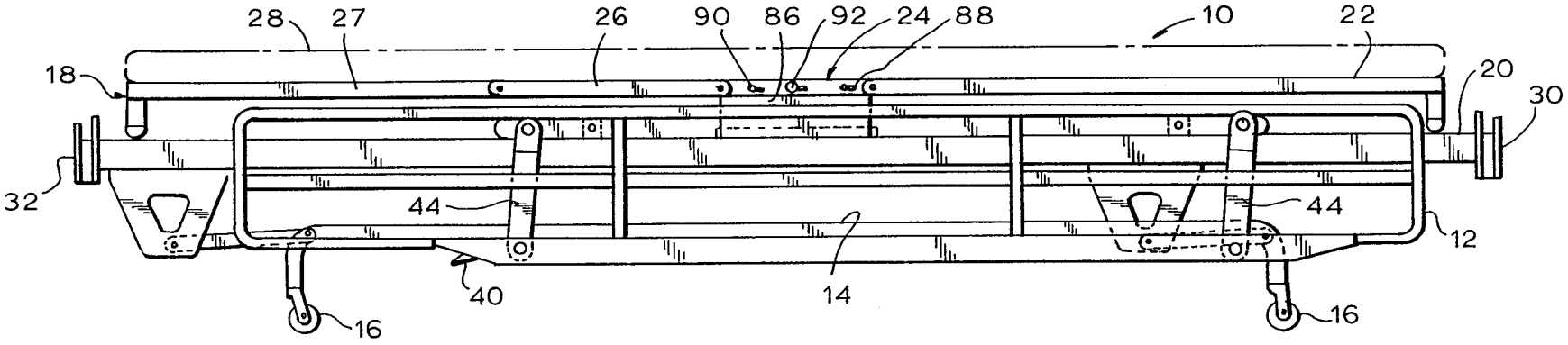
FIG. 2 is a side elevation view thereof.
Figure 3:
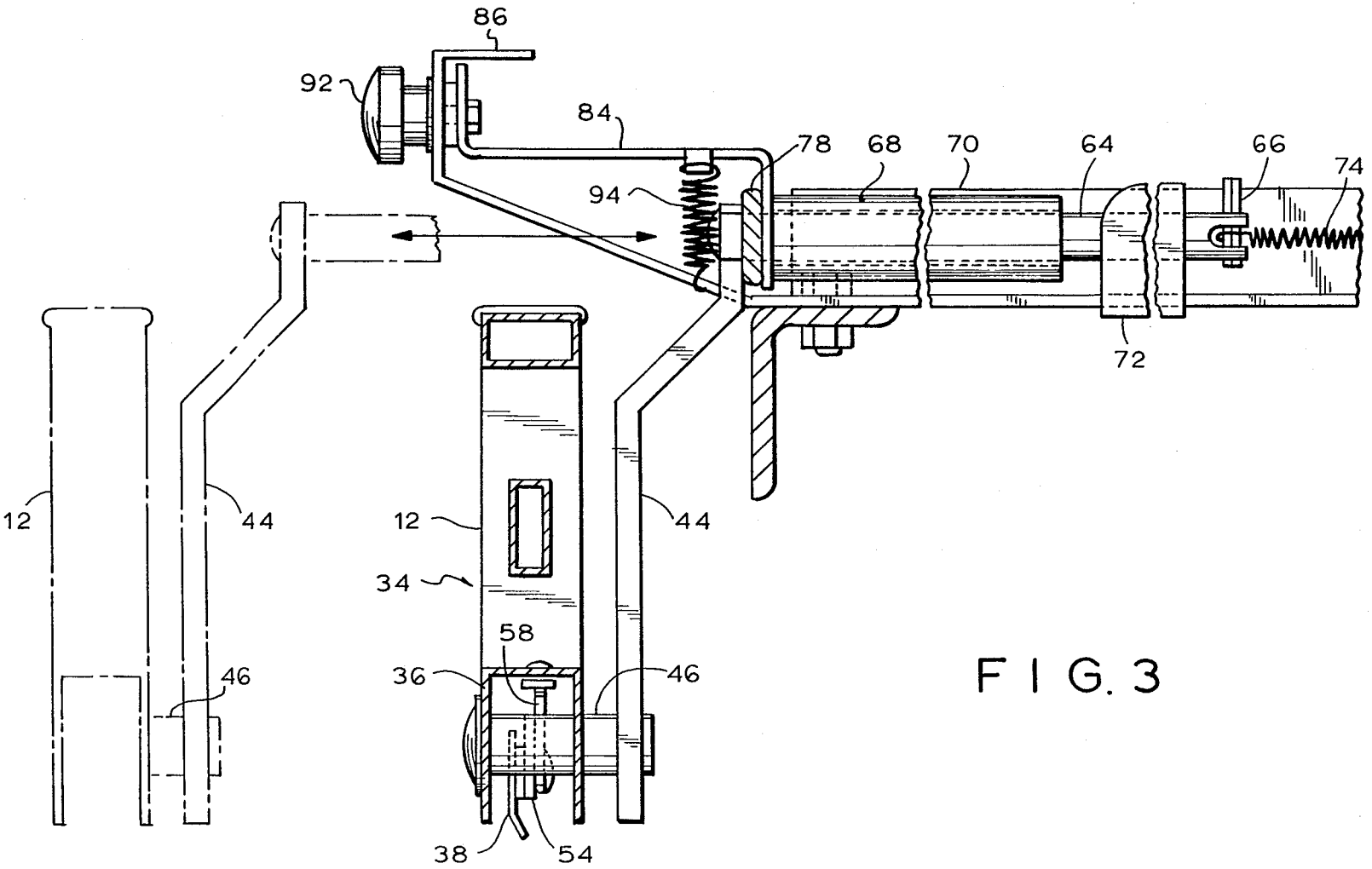
FIG. 3 is an enlarged sectional view illustrating a portion of the rail assembly and supporting frame of the hospital bed.
Figure 5:
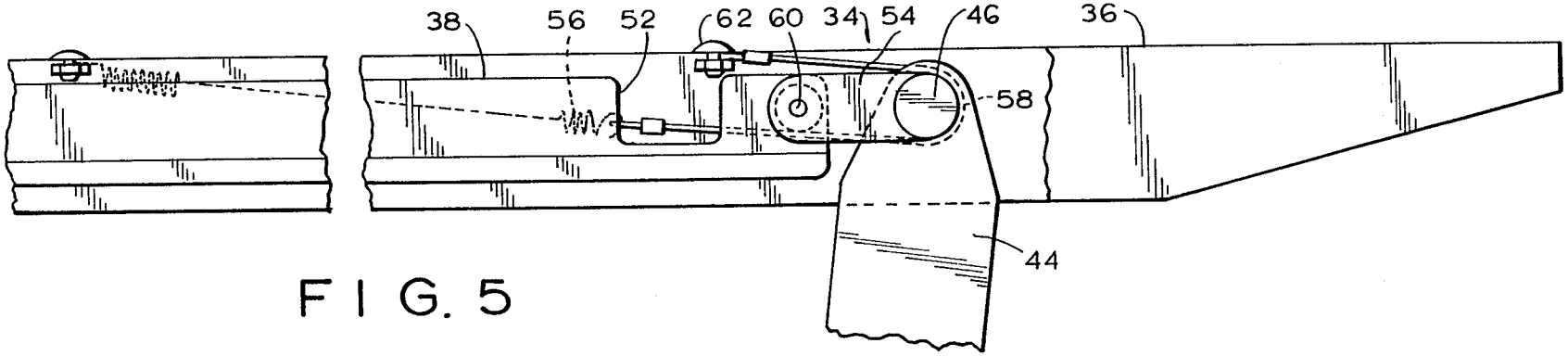
FIG. 5 is a similar view to FIG. 4 illustrating the rail assembly in a different position.
Figure 6:
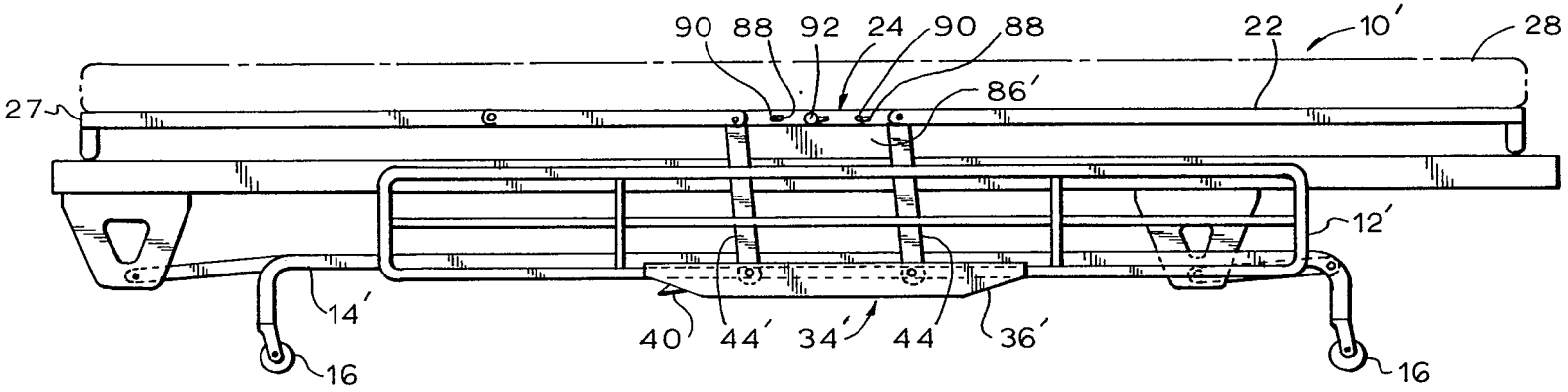
FIG. 6 is a side elevation view of a hospital bed having a smaller rail than that shown in FIG. 2.

A hospital bed 10 having a full length rail 12 as shown in FIGS. 1–2 or a rail 12′ of shorter length, as shown in FIG. 6, is provided. Primed numerals are used herein to refer to parts shown in FIGS. 6, 7A and 7B which are similar, but not necessarily identical to the corresponding enumerated parts in the embodiment of the invention shown in FIGS. 1–5 and 8–9. The same numerals are used for both embodiments where substantially identical parts are employed. In either case, the rail is adjustable both vertically and horizontally to allow it to protect a patient or be stored under the bed when not in use.

The bed 10 (10′ in FIG. 6) includes a base 14 (14′ in FIG. 6) supported by four wheels 16. An angle iron frame assembly 20 (20′ in FIGS. 6 and 7) is supported by the base 16. The frame assembly 20 supports an articulatable frame 18 including back, seat, thigh and foot portions 22,24,26,27. Each portion may include a wire grid supported by a plurality of coil springs (not shown). Movement of these portions may be accomplished manually by means of cranks or by employing one or more electric motors. Both approaches are well known to the art and require no further discussion herein. A mattress 28 is supported by the grid. A head panel 30 and a foot panel 32 are mounted to opposing ends of the frame assembly 20.

Referring to FIGS. 3–5 and 7A–7B, a rail assembly 34 (34′ in FIGS. 7A–7B) is shown for supporting the side rails 12 (12′) and allowing them to be moved to a desired position. Each rail 12 includes a U-shaped housing 36 (36′) secured to the bottom portion thereof, a connecting link 38 (38′) positioned within the housing, and a latch 40 (FIG. 7A) positioned near one end of the connecting link. A latch spring 42 is provided for urging the latch 40 into engagement with a shoulder 38A (FIG. 7A) defining the end of the link.

Figures 7A, 7B:
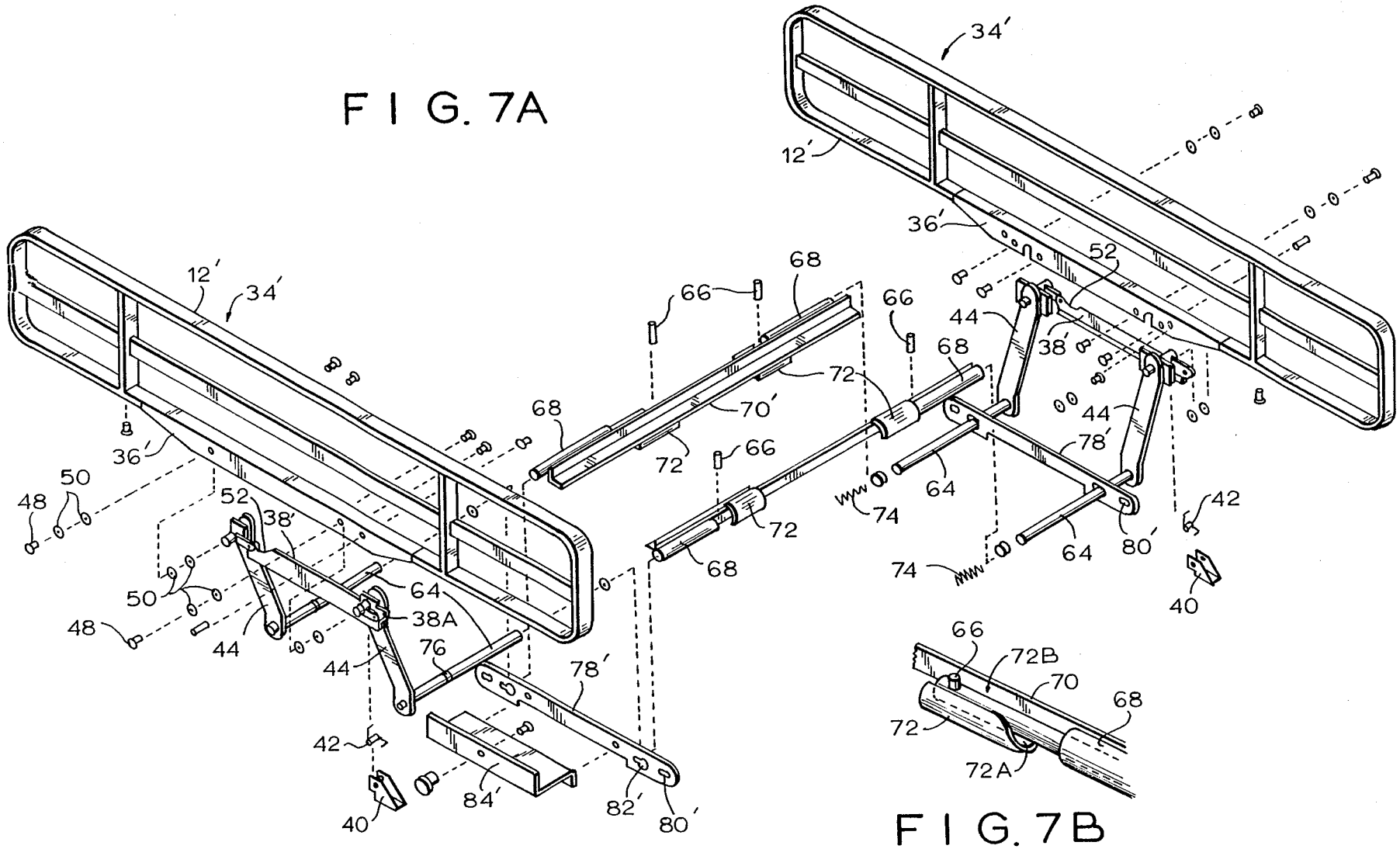
FIG. 7A is an exploded, perspective view of the rail assembly shown in FIG. 6.
FIG. 7B is an enlarged, perspective view of a portion of the rail assembly shown in FIG. 7A and a portion of the bed frame.

A pair of pivot arms 44 are secured to each rail housing 36 (36′) by means of a pair of pivot pins 46, a pair of button screws 48, and a plurality of washers 50 as shown in FIG. 7A. The connecting link includes two notches 52 therein to accomodate the respective pivot pins. Steel rivets 53 secure the housing 36′ to the rail 12′.

Figure 4:
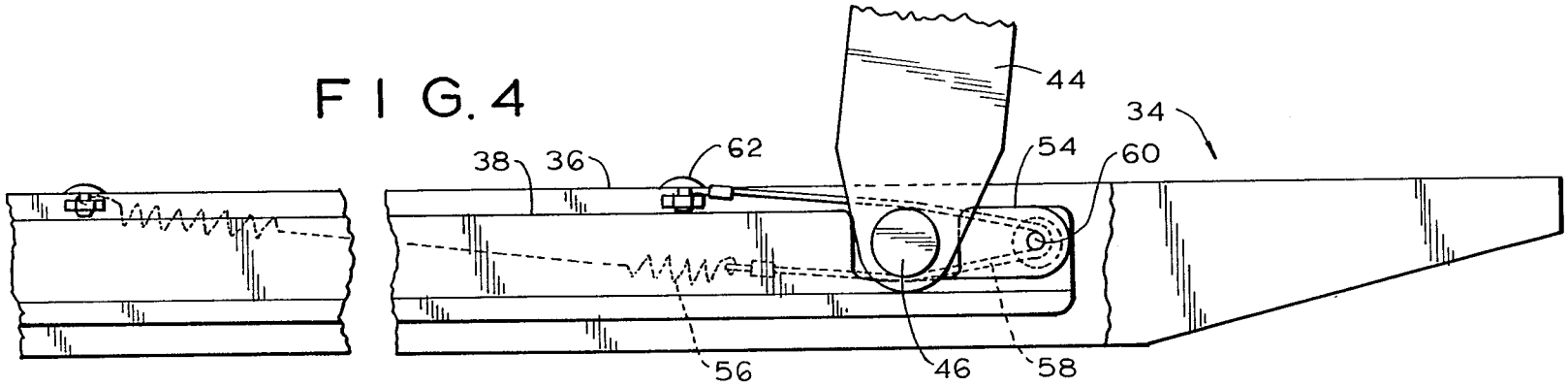
FIG. 4 is an enlarged side elevation view of a portion of the rail assembly.

In order to prevent the rail 12 from dropping rapidly upon release of the latch 40, a braking mechanism as shown in FIGS. 4–5 is incorporated within the rail housing. The braking mechanism includes a cam link 54, a retractor spring 56, and a cable 58 having one end secured to the retractor spring and an opposite end secured to the rail housing 36. The cam link 54 is riveted to the connecting link 38 at one end and secured to a pivot pin 46 at its other end. A second cam link (not shown) connects the opposite end of the connecting link with the second pivot pin. The cam link, cable and spring are arranged such that the spring increases in length as the pivot arms 44 (and cam link) rotate to move the rail 12 downwardly, thereby tending to resist the downward movement thereof. Upon raising the rail, the spring length shortens and works to offset the gravitational forces urging the rail downwardly. FIG. 4 shows the positions of the pivot arm connecting link and cam link when the rail is in a lowered position. The axis (i.e. the rivet 60 connecting the cam link to the connecting link) about which the cable extends is positioned relatively far from the bolt 62 which secures the retractor spring 56 to the rail housing. The spring is accordingly extended as the cable is not elastic. In contrast, FIG. 5 shows the rail in the operating position. The axis about which the cable is wrapped (i.e. the pivot pin 46) is closer to bolt 62 which allows the spring 56 to contract. When the pivot pin 46 shown in FIG. 5 is positioned outside of the notch 52 in the connecting link, the second pivot pin, not shown in the figure, is positioned within the second notch (also not shown in this figure) within the connecting link. The notches assure that the pivot arms and cam links will be locked in the proper positions when the rail is either raised or stored. The cam links should be maintained in a non-horizontal position to facilitate their rotation upon exertion of a horizontal force upon the unlatched rail 12.

A pair of parallel mounting shafts 64 are provided for mounting each rail 12 (or 12') to the main frame assembly 20 (or 20'). One end of each shaft is pivotably secured to one of the Pivot arms 44. The opposite ends therof are bifurcated and each includes a roll pin 66 extending therefrom. Slide tubes 68 are mounted to cross rails 70 (70') of the frame assembly 20 (20') for receiving the mounting shafts 64. Stop members 72 are secured to the cross rails 70 adjacent the inner ends of the slide tubes 68. At least one of the stop members 72 associated with each rail 12 (12') includes an angular surface 72A facing the inner end of the slide tube 68 as best shown in FIG. 7B. The stop member together with the cross rail, further defines a channel 72B within which the mounting shaft 64 may be positioned, the channel having an elongate opening to prevent the roll pin 66 from interfering with the movement of the mounting shaft. The roll pin is oriented towards the channel opening when the rail is in the down position.

The distance between the leading edge of the angular surface 72A and the slide tube 68 is approximately equal to the diameter of the roll pin. When the rail 12 is pulled out and then moved to the up position, thereby rotating the pivot arms 44 and mounting shafts 64, the angular surface 72A urges the roll pin outwardly. The rail will accordingly be located in its outermost position when fully raised. The location of the pin between the stop member and slide tube assures that there will be virtually no lateral play associated with the rail when in use.

A pair of retractor springs 74 are provided for resiliently urging each of the opposing rail assemblies 34 towards the center of the bed 10. Each spring 74 is secured to the bifurcated ends of an opposing pair of mounting shafts 64. The portion of the roll pin extending between the bifurcated portions of each shaft serves as a spring affixation member. FIG. 7B illustrates the position of a mounting shaft and associated roll pin after the rail has been pulled by the retractor springs 74 to a storage position beneath the articulatable frame which supports the mattress.

A second latch mechanism is provided for maintaining the rail 12 in the outermost lateral position with respect to the bed frame. FIGS. 3, 7A, 8 and 9 best illustrate this mechanism. The principles of operation of the mechanisms shown in FIGS. 1–2, 8–9 and 6, 7A–7B are the same, the only structural differences being those to accomodate the different spacings of the pivot arms 44, and therefor the mounting shafts 64, used in conjunction with the different size rails 12 and 12'.

Referring to FIGS. 1–3 and 8–9, the mounting shafts 64 each include a peripheral groove 76 therein. A catch bar 78 having a pair of elongate holes 80 and a pair of keyholes 82 extends perpendicularly to the mounting shafts 64, each of the shafts extending through one of the keyholes. The catch bar 78 is secured to a catch link 84 which is, in turn, secured to a cover plate 86. The cover plate 86 includes a plurality of elongate openings 88 through which shoulder bolts 90 and a release latch 92 extend. The catch link is accordingly movable with respect to the cover plate although secured thereto by means of the shoulder bolts. A retractor spring 94 having one end secured to the catch link and the other end to the cover plate resiliently urges the catch link, and therefore the catch bar, in the latching direction. The cover plate, being bolted to the frame assembly 20, is immobile.

Since the length of the catch bar 78 in the above figures is several feet, a pair of catch bar supports 96 are secured thereto to maintain it in a horizontal position. The catch bar supports are bolted to the main frame assembly 20.

A similar locking mechanism is shown in FIGS. 6 and 7A–7B. The catch bars 78' employed in the embodiment include elongate openings 80' and keyholes 82' in different relative locations for mounting them to the cover plates 86'. Since the catch bars are considerably shorter than those in the above-described embodiment of the invention, additional supports are not required.

The second latch mechanism maintains the rail assembly 34 (34') in its outermost position regardless of the vertical position thereof unless the release latch is actuated. The smaller portions of the keyholes engage the grooved portions of the respective mounting shafts, thereby preventing the rail from being moved inwardly. If the latch is accidentally actuated when the rail is in the raised position, the stop members 72 act as a safety mechanism by maintaining the rail in the outer position.

The release latch 92 is normally utilized after the rail 12 has been fully lowered. By exerting a horizontal force in the appropriate direction upon the release latch, the catch bar 78 (78') is moved such that the large portions of the keyholes 82 (82') are aligned with the mounting shafts 64. This allows the retractor spring 74 to pull the mounting shafts and rail 12 connected thereto inwardly to the position shown in FIG. 8. When the rail is pulled out from under the bed, the catch bar 78 (78') automatically engages the grooved portion of the mounting shaft due to the force exerted on the catch link 84 (84') by the retractor spring 94 secured thereto.

What is claimed is:

1. A hospital bed comprising:

a bed frame;

first and second substantially parallel slide tubes mounted to said bed frame and extending laterally with respect thereto;

first and second mounting shafts slidably positioned, respectively, within said first and second slide tubes and rotatable therein;

first and second pivot arms secured, respectively, to said first and second mounting shafts;

a safety rail mounted to said first and second pivot arms;

abutment means mounted to at least one of said first and second mounting shafts and rotatable therewith; and stop means mounted to said bed frame for abutting said abutment means when said abutment means is in a first rotational position, but allowing said abutment means to move thereby when said abutment means is in a second rotational position as said mounting shafts slide within said slide tubes.

2. A hospital bed as defined in claim 1 wherein said abutment means is a projection extending radially from said first mounting shaft.

3. A hospital bed as defined in claim 2 wherein said stop means includes an angular surface for abutting said projection as said first mounting shaft is rotated about its longitudinal axis, said angular surface thereby urging said first mounting shaft in a first lateral direction with respect to said bed frame as said first mounting shaft is rotated about its longitudinal axis while said abutment means contacts said angular surface.

4. A hospital bed as defined in claim 3 including means for resiliently urging said safety rail in a second lateral direction opposite to said first lateral direction.

5. A hospital bed as defined in claim 2 including a channel defined between said stop means and said bed frame, said projection being movable through said channel only when said first mounting shaft is in said second rotational position.

6. A hospital bed as defined in claim 1 including means for resiliently urging said safety rail towards said bed frame.

7. A hospital bed as defined in claim 6 wherein said means for resiliently urging said safety rail towards said bed frame is a coil spring.

8. A hospital bed as defined in claim 2 where said stop means is positioned adjacent to an inner end of said first slide tube, said inner end of said first slide tube and said stop means defining opposing surfaces between which said projection is positioned when said mounting shaft is in said first rotational position, said safety rail thereby substantially being prevented from moving laterally with respect to said bed frame when said projection is between said opposing surfaces.

9. A hospital bed as defined in claim 8 wherein said opposing surface defined by said stop means is an inclined surface.

10. A hospital bed comprising:

a bed frame;

a rail assembly mounted to said bed frame, said rail assembly including a safety rail;

first means for moving said rail assembly vertically with respect to said bed frame between raised and lowered positions;

second means for moving said rail assembly laterally with respect to said bed frame between a stored position under said bed frame and an operating position away from said bed frame;

said first and second moving means including first and second laterally extending slide tubes secured to said bed frame, first and second mounting shafts slidably and rotatably positioned within said respective first and second slide tubes, and first and second pivot arms secured, respectively, to said first and second mounting shafts and to said safety rail;

first latch means for locking said rail assembly in said raised position;

second latch means for locking said rail assembly in said operating position; and means resiliently urging said rail assembly towards said stored position.

11. A hospital bed as defined in claim 10 wherein said means resiliently urging said rail assembly towards said stored position is a coil spring secured to said rail assembly.

12. A hospital bed as defined in claim 11 including a second rail assembly mounted to said bed frame in opposing relation to said rail assembly, said coil spring being secured to each of said rail assemblies and urging them towards each other.

13. A hospital bed as defined in claim 10 including a projection extending radially from said first mounting shaft, a stop member mounted to said bed frame, said stop member including an abutment surface for engaging said projection if said rail assembly is moved towards said bed frame while in said raised position, said abutment surface being positioned to avoid contacting said projection if said first mounting shaft is rotated to move said rail assembly to said lowered position, thereby allowing said rail assembly to be moved laterally towards said stored position while in said lowered position.

14. A hospital bed as defined in claim 13 wherein said stop member is positioned adjacent to an inner end of said first slide tube.

15. A rail assembly comprising:

first and second pivot arms;

a safety rail pivotably mounted to said first and second pivot arms, said safety rail being movable between raised and lowered positions as said pivot arms are rotated about first and second pivot axes, respectively;

braking means for resisting the force of gravity as said safety rail moves from said raised position to said lowered position, said braking means including a first pivot pin and a second pivot pin, said first pivot arm being secured to said first pivot pin and said second pivot arm being secured to said second pivot pin, a cam link secured to said first pivot pin and rotatable therewith, a connecting link pivotably secured to said cam link, a spring, and spring attaching means connecting said spring and said cam link whereby said spring exerts an increasing force against rotation of said cam link in a first rotational direction.

16. A rail assembly as defined in claim 15 including a cable having one end secured to said spring and a second end secured to said safety rail, said cam link including means for bearing against said cable as it is rotated in said first rotational direction.

17. A rail assembly as defined in claim 15 including a second cam link secured to said second pivot pin and rotatable therewith, said connecting link including a first end portion secured to said cam link and a second end portion secured to said second cam link.

18. A rail assembly as defined in claim 17 wherein said connecting link includes a pair of notches therein, said first and second pivot pins being positionable, respectively, within one of said pair of notches.

* * * * *